US006422148B1

(12) United States Patent
Xu et al.

(10) Patent No.: US 6,422,148 B1
(45) Date of Patent: Jul. 23, 2002

(54) IMPERMEABLE AND COMPOSITE PERFORATING GUN ASSEMBLY COMPONENTS

(75) Inventors: Zheng Rong Xu, Sugar Land; Manish Kothari, Stafford; Robert A. Parrott, Houston; Haoming Li, Missouri City, all of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 21 days.

(21) Appl. No.: 09/633,163

(22) Filed: Aug. 4, 2000

(51) Int. Cl.[7] ..... F42B 3/087

(52) U.S. Cl. ..... 102/313; 102/307; 102/312; 102/378

(58) Field of Search ..... 102/307, 312, 102/313, 378

(56) References Cited

U.S. PATENT DOCUMENTS

| | | | | | |
|---|---|---|---|---|---|
| 2,749,840 | A | | 6/1956 | Babcock | 102/20 |
| 2,968,243 | A | | 1/1961 | Turechek | 102/20 |
| 3,211,093 | A | | 10/1965 | McCullough et al. | 102/20 |
| 3,453,960 | A | * | 7/1969 | Qualls | 102/49.5 |
| 3,486,410 | A | * | 12/1969 | Drexelius et al. | 89/1 |
| 3,688,988 | A | * | 9/1972 | Howison et al. | 102/378 X |
| 3,698,281 | A | * | 10/1972 | Brandt et al. | 89/1 B |
| 4,253,523 | A | | 3/1981 | Ibsen | 166/299 |
| 4,393,946 | A | | 7/1983 | Pottier et al. | 175/4.56 |
| 4,467,878 | A | | 8/1984 | Ibsen | 175/4.6 |
| 4,537,255 | A | | 8/1985 | Regalbuto et al. | 166/297 |
| 4,633,951 | A | | 1/1987 | Hill et al. | 166/308 |
| 4,683,943 | A | | 8/1987 | Hill et al. | 166/63 |
| 4,685,376 | A | * | 8/1987 | Noel et al. | 89/1.14 |
| 4,718,493 | A | | 1/1988 | Hill et al. | 166/308 |
| 4,778,009 | A | * | 10/1988 | Sumner et al. | 89/1.15 |
| 4,823,875 | A | | 4/1989 | Hill | 166/280 |
| 4,885,993 | A | * | 12/1989 | Hancock et al. | 102/307 |
| 4,901,802 | A | * | 2/1990 | George et al. | 102/312 X |
| 4,905,759 | A | | 3/1990 | Wesson et al. | 166/55 |
| 4,958,569 | A | | 9/1990 | Mandigo | 102/476 |
| 5,044,437 | A | | 9/1991 | Wittrisch | 166/250 |
| 5,098,487 | A | | 3/1992 | Brauer et al. | 148/432 |
| 5,148,868 | A | | 9/1992 | Christian | 166/297 |
| 5,303,772 | A | | 4/1994 | George et al. | 166/55.1 |
| 5,318,126 | A | | 6/1994 | Edwards et al. | 166/297 |
| 5,327,974 | A | | 7/1994 | Donovan et al. | 166/311 |
| 5,366,014 | A | | 11/1994 | George | 166/297 |
| 5,398,760 | A | | 3/1995 | George et al. | 166/297 |
| 5,415,101 | A | | 5/1995 | Brinkmann | 102/307 |
| 5,477,785 | A | | 12/1995 | Bieman, Jr. et al. | 102/313 |
| 5,490,563 | A | | 2/1996 | Wesson et al. | 166/297 |
| 5,509,356 | A | | 4/1996 | Renfro | 102/307 |
| 5,509,481 | A | | 4/1996 | Huber et al. | 166/297 |
| 5,598,891 | A | | 2/1997 | Snider et al. | 166/308 |
| 5,829,538 | A | | 11/1998 | Wesson et al. | 175/4.6 |
| 5,847,312 | A | | 12/1998 | Walters et al. | 102/309 |
| 5,960,894 | A | | 10/1999 | Lilly et al. | 175/4.6 |
| 5,988,702 | A | | 11/1999 | Sas-Jaworsky | 285/249 |
| 6,170,400 | B1 | * | 1/2001 | Salort | 102/313 |
| 6,250,227 | B1 | * | 6/2001 | Salort | 102/378 |

* cited by examiner

*Primary Examiner*—Peter A. Nelson
(74) *Attorney, Agent, or Firm*—Jaime A. Castano; Jeffrey E. Griffin; Brigitte L. Jeffery

(57) ABSTRACT

A perforating gun assembly that includes at least one component that is constructed from a composite material and that is impermeable to wellbore fluids. The components may include the outer carrier and/or loading tube of a perforating gun, the connecting tubing of a gun release mechanism, and the gun connector used to attach adjacent perforating guns. The composite material is designed to be very brittle under dynamic impact. The component is made impermeable to wellbore fluids by including an impermeable liner therein. The impermeable liner can be bonded to the inner or outer surface of the component or can be embedded within the component. Since it is brittle under dynamic impact, the composite component shatters into small pieces upon detonation of the perforating gun.

26 Claims, 5 Drawing Sheets

IMPERMEABLE AND COMPOSITE PERFORATING GUN ASSEMBLY COMPONENTS

BACKGROUND OF THE INVENTION

1. Field of Invention

This invention relates generally to downhole perforating gun assemblies and the components associated therewith. More particularly, this invention relates to the use of a composite material to construct impermeable components of a perforating gun assembly.

2. Description of the Art

A perforating gun typically is used to form perforation tunnels in a downhole formation for purposes of enhancing the production of well fluids from the formation. The perforating gun may be part of a perforating gun assembly, an assembly that may include several perforating guns and other components. The perforating gun assembly is typically positioned downhole to the desired perforating depth via a wireline or tubing, as examples. The firing of a perforating gun normally involves detonating its shaped charges, devices that create radial perforation jets when detonated to form the perforation tunnels. To detonate the shaped charges, the perforating gun assembly typically also includes a firing head to initiate a detonation wave on a detonating cord that extends to the shaped charges. In this manner, when the detonation wave reaches a particular shaped charge, the shaped charge detonates to form a corresponding perforation jet. In addition to the shaped charges and firing head, the perforating gun assembly may include several additional components.

Each perforating gun may consist of an outer cylindrical tube called a "carrier" and a loading tube located inside of the carrier. The carrier acts like a pressure vessel for the perforating gun and the included shaped charges. The loading tube has two main functions: [1] to mechanically hold the shaped charges within the carrier at a certain phasing and distance, and [2] to absorb energy coming from the fragmenting case and expanding gaseous products from the shaped charges so that the damage to the carrier is reduced.

The perforating gun assembly may also include a mechanical release mechanism to release the perforating guns from the conveyance string after the perforating guns fire. Due to this release, the perforating guns fall due to gravity into the rathole of the well. The remaining perforating gun string may then be retrieved from the well.

In the past, each of the listed perforating gun assembly components has been constructed from metallic materials. However, the use of metallic materials for perforating gun assembly components has several disadvantages.

For instance, when the shaped charges are detonated, the metal loading tube expands due to case impact and explosive gaseous expansion. The amount of loading tube expansion is limited by the inner diameter of the metal carrier. As soon as the loading tube collides with the inner diameter of the carrier, the energy from the loading tube is transmitted to the carrier. The metal carrier then swells outwardly (becoming permanently deformed) under the impact of the loading tube and may fragment into pieces. The amount of outward deformation and/or fragmentation depends on the properties of the metal from which the loading tube and the carrier are constructed.

The swelling of the gun is disadvantageous for several reasons. First, the swelling of the gun increases the overall outside diameter of the carrier/perforating gun thereby increasing the chances that the perforating gun will become stuck in the wellbore as it is extracted from the downhole environment. In addition, a number of wellbores have minimum restriction diameters wherein the guns when fired cannot swell more than this minimum restriction diameter. As a result, the guns used in such wellbores are usually at least 8–10% smaller in diameter than the minimum restriction diameter of the wellbores (thereby allowing for the post-firing swell). This 8–10% compensation in diameter effectively reduces the size of the shaped charges that fit inside the carrier thereby also reducing the performance of the gun. It would thus be beneficial to the prior art to provide a perforating gun (carrier and/or loading tube) that does not swell after being fired. The prior art would also benefit from a perforating gun that can be deployed in wellbores in which the minimum restriction diameter of the wellbore equals or substantially equals the outer diameter of the non-fired perforating gun.

Likewise, the fragmentation of the gun can also be disadvantageous. If the carrier and loading tube fragment only partially, then such fragments may also present an obstruction in the retrieval of the perforating gun. If the carrier and loading tube fragment into large pieces that remain in the wellbore, such fragments may cause problems in the subsequent operation of the well particularly if they are somehow lifted into the completion of the wellbore. Therefore, it would be beneficial to the prior art to provide a perforating gun that does not produce an obstruction for its retrieval after firing. It would also be beneficial to the prior art to provide a perforating gun that does not fragment into large pieces as a result of firing.

The use of metal in each of the listed components also serves to increase the overall weight of the perforating gun assembly. It would be beneficial to the prior art to provide a perforating gun assembly that is lower in weight than corresponding metal perforating gun assemblies.

U.S. Pat. No. 5,960,894 issued to Lilly et al. has attempted to solve at least some of these problems. The Lilly Patent discloses a perforating gun comprising an outer tube and an inner structure for holding the charges. The outer tube is made from a material having a high strength and low impact resistance, such as carbon fibers, glass fiber, or combinations thereof, that are molded in an embrittled resin, a metal matrix, or a ceramic matrix. The inner structure is made from a combustible material such as nitrocellulose, wood cellulose, cardboard, fiberboard, thermoplastic, thermoset resin, thin gauge metals, structural foam, and the like. Upon detonation of the charges, the frangible nature of the outer structure causes it to fragment into small pieces, preferably less than about 3 inches in size. The inner structure is combustibly consumed by the detonation leaving ash and residue. While this design reduces the amount of debris remaining after the perforating gun is fired, the Lilly design may not function satisfactorily if the gun assembly requires a pressure tight seal against the wellbore fluids and if the gun assembly is constructed from a composite material.

Composite materials, especially polymer matrix composites, tend to be permeable to fluids (including gases), especially to fluids under the severe pressure and temperature environment present in a wellbore. When disposed in such harsh environments, microcracks and microvoids that are inevitably formed in such composite materials lead to the formation of leak paths therethrough. Thus, the Lilly gun design constructed from composite material may become filled with wellbore fluids when disposed downhole. If this happens, the shaped charges inside the carrier will not perforate. In general, a perforating gun filled with fluid is like a bomb that will extensively damage the casing of the wellbore. To prevent such occurrence, the entire perforating gun assembly (and not only the actual perforating gun) should be impermeable to wellbore fluids. It would thus be beneficial to the prior art to provide a perforating gun assembly that does not suffer from the listed drawbacks.

Thus, there is a continuing need for an arrangement that addresses one or more of the problems that are stated above.

SUMMARY OF THE INVENTION

It is therefore an objective of the present invention to provide a perforating gun assembly that:

- includes a perforating gun that does not swell after being fired;
- can be deployed in wellbores in which the minimum restriction diameter of the wellbore equals or substantially equals the outer diameter of the associated non-fired perforating gun;
- includes a perforating gun that does not produce an obstruction for its retrieval after firing;
- includes a perforating gun that does not fragment into large pieces as a result of firing;
- is lighter than prior art perforating gun assemblies; and
- includes components constructed from composite materials and that are impermeable to the surrounding wellbore fluids.

Other objectives of the present invention will be obvious by reading the specification and claims appended hereto.

To achieve such objectives, our invention is a perforating gun assembly that includes at least one component that is constructed from a composite material and that is impermeable to wellbore fluids. The components may include the outer carrier and/or loading tube of a perforating gun, the connecting tubing of a gun release mechanism, and the gun connector used to attach adjacent perforating guns. The composite material is designed to be very brittle under dynamic impact. The component is made impermeable to wellbore fluids by including an impermeable liner therein. The impermeable liner can be bonded to the inner or outer surface of the component or can be embedded within the component. Since it is brittle under dynamic impact, the composite component shatters into small pieces upon detonation of the perforating gun.

DETAILED DESCRIPTION OF THE INVENTION

Figure 1:
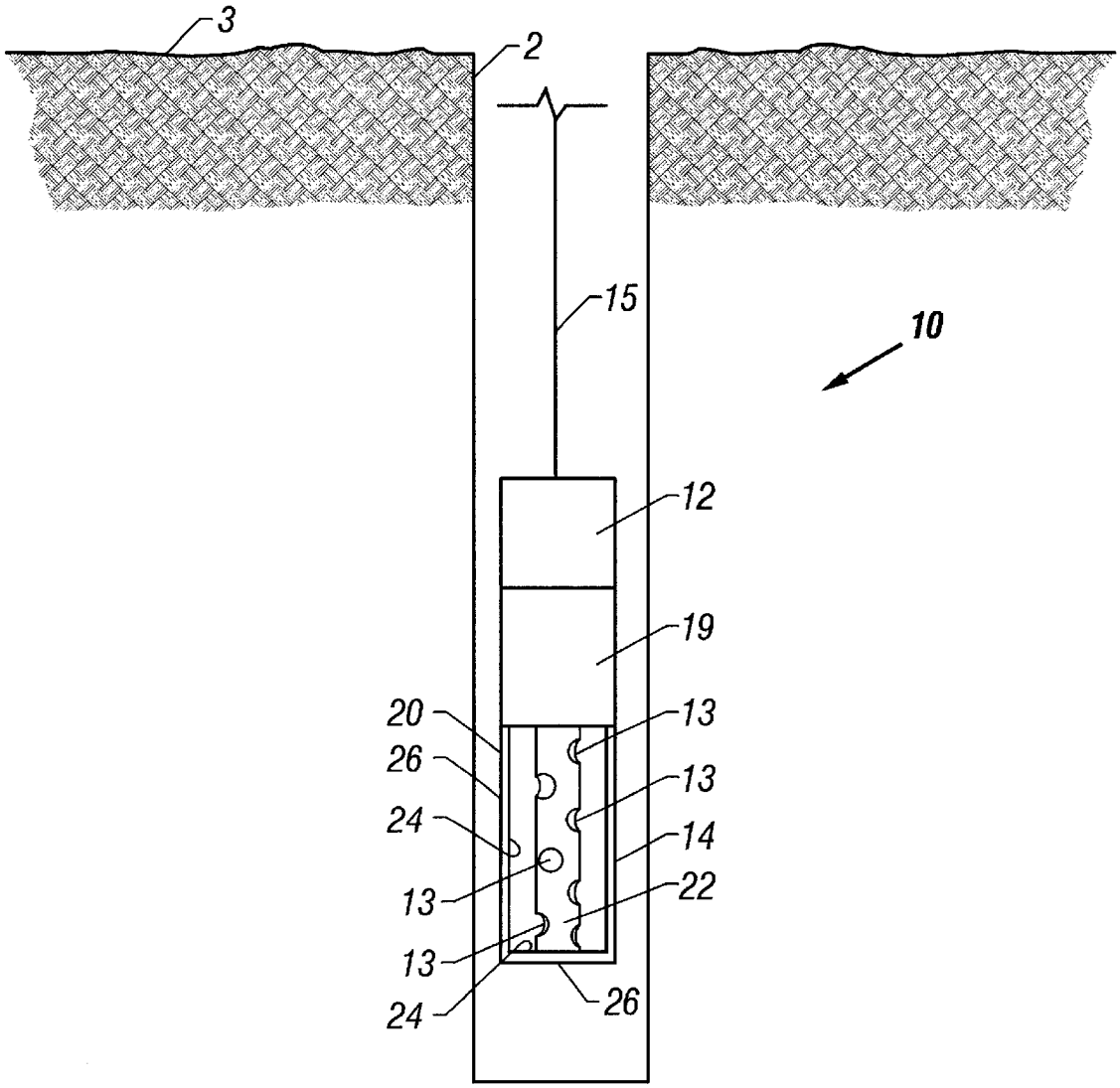
FIG. 1 is an elevational and partial cross-sectional view of the perforating gun assembly.
Figure 8:
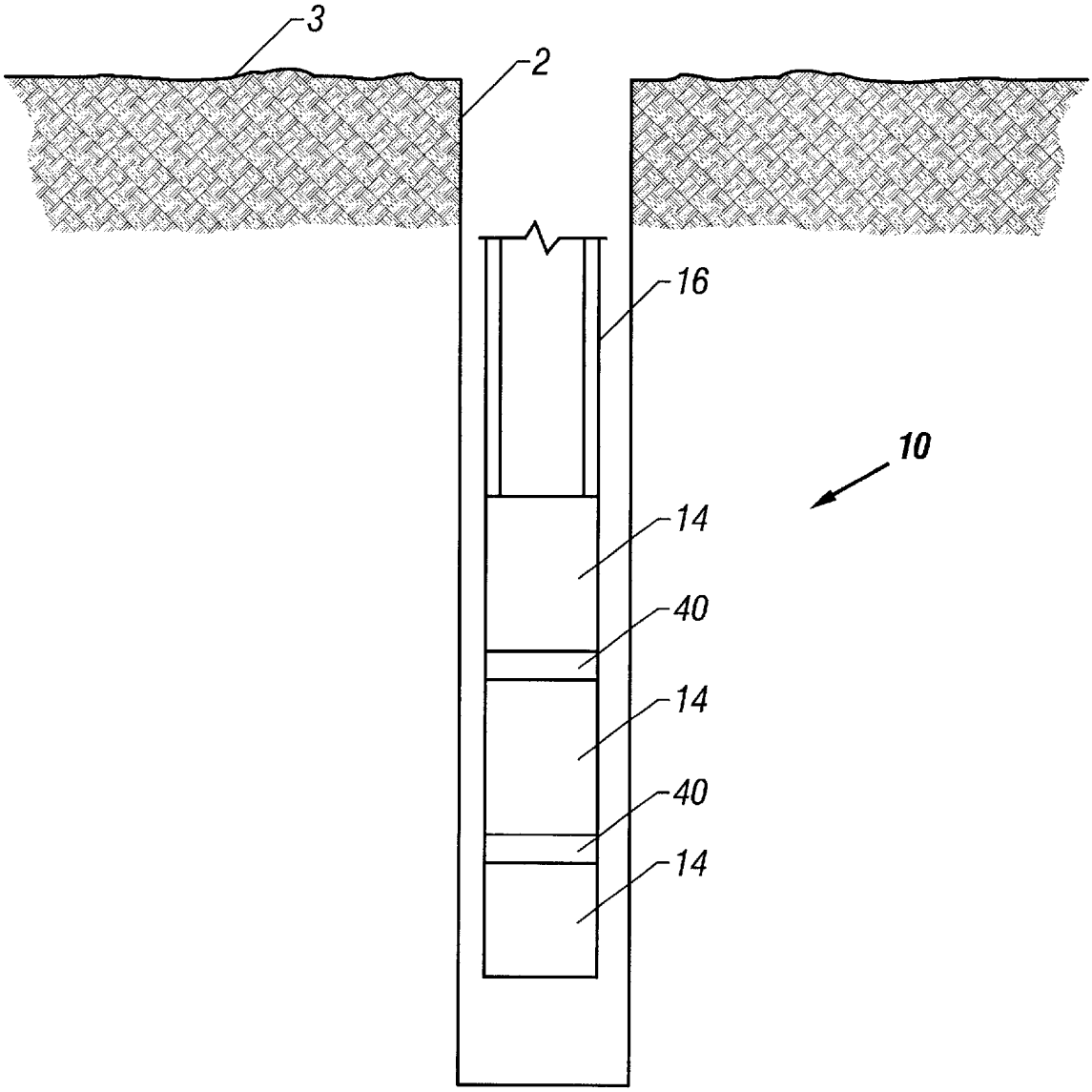
FIG. 8 is an elevational view of the perforating gun assembly including more than one perforating gun.

FIG. 1 illustrates a wellbore 2 that extends into the ground from the surface 3. Wellbore 2 may be cased or uncased. A perforating gun assembly 10 is disposed within the wellbore 2 to perforate the wellbore 2. Perforating gun assembly 10 may include a firing head 12 used to initiate a detonation wave on a detonating cord (not shown) that extends to the shaped charges 13 of one or more perforating guns 14. Although FIG. 1 includes only one perforating gun 14, the perforating gun assembly 10 may include multiple perforating guns 14 that are attached to the assembly 10 below the top perforating gun 14 (as shown in FIG. 8). The assembly is shown in FIG. 1 as being suspended by a wireline 15, although the assembly 10 may be deployed downhole in a variety of ways known in the art, such as part of a coiled tubing assembly, a wireline assembly, or a conveyance string assembly 16 (as shown in FIG. 8) that extends from the surface of the well, as examples.

Perforating gun 14 typically includes an outer carrier 20 and a loading tube 22. As previously disclosed, the outer carrier 20 acts like a pressure vessel for the perforating gun 14 and the included shaped charges 13. The loading tube 22 is located, preferably concentrically, within the outer carrier 13. The loading tube 22 has two main functions: [1] to mechanically hold the shaped charges 13 within the carrier 20 at a certain phasing and distance, and [2] to absorb energy coming from the fragmenting gun 14 and expanding gaseous products from the shaped charges 13 so that the damage to the gun 14 is reduced.

In some embodiments and as shown in FIG. 1, the perforating gun assembly 10 also includes a perforating gun release mechanism, or connector assembly 19. The connector assembly 19 releasably secures the perforating gun 14 to the portion of the assembly 10 that is located above the gun 14. Generally, when the top perforating gun 14 fires, the connector assembly 19 releases the perforating guns from the rest of the assembly 10. As a result, the top perforating gun 14 and any other perforating guns 14 that are attached below the top perforating gun 14 drop into the rathole of the well 2.

As shown in FIG. 8, perforating gun assembly 10 may also include gun connectors 40 (including adaptors) between adjacent perforating guns 14. Connectors 40, which are known in the art, couple adjacent perforating guns 14 together.

Our invention comprises constructing perforating gun assembly 10 components out of composite materials and making them impermeable to the surrounding wellbore fluids. By example, our invention comprises the use of composite materials in the perforating gun 14, the connector assembly 19, and the connectors 40. Although not illustrated in the Figures, our invention also comprises the use of composite materials in other perforating gun assembly 10 components, such as firing heads, orienting tools, bottom noses, etc. that are functionally associated with the perforating gun assembly.

The composite materials used in our invention must be designed to be very brittle under the dynamic impact caused by the firing of the shaped charges. Such composite materials may be made from several different fibers and matrix materials. The fibers can be carbon, glass, kevlar, nomex, and/or aramid fibers. The matrix materials can be polymers (such as thermosets and thermoplastics), ceramics, carbons, metals (preferably brittle metals), and/or intermetallics. For example, the composite material may be constructed from glass or carbon fibers and epoxy as a matrix material. The fibers may be embedded in a single matrix material or in a mixture of more than one matrix material. The fibers may all have the same type or may be formed from fibers of different types. Since the composite materials are brittle under dynamic impact, the perforating gun assembly components constructed from the composite materials will shatter into fine pieces once the perforating gun 14 is fired. In the preferred embodiment, the shattered pieces are not larger than 3 inches each.

In addition, the composite materials used in our invention must be impermeable to well fluids in order to allow the safe and satisfactory firing of the perforating gun 14. As previously disclosed, composite materials tend to be permeable. If the perforating gun assembly 10 becomes filled with wellbore fluids, the perforating gun 14 will either not fire or will essentially act as a bomb and cause extensive damage to the casing of the wellbore 2 when fired. In the preferred embodiment, the composite materials are made impermeable by the inclusion of an impermeable liner therein. The liner can be constructed from any impermeable material that can seal the relevant perforating gun assembly component from the surrounding wellbore fluids (at the given temperature, pressure, etc.). Adequate liner materials include rubbers, thermoplastics, or thermoplastic elastomers, such as nitrile rubber, polyamide, polyketone, high density polyethylene, and fluoropolymers (such as polyvinylidende fluoride, teflon, polytetrafluoroethylene, and ethylene-tetrafluoroethylene).

Figure 2:
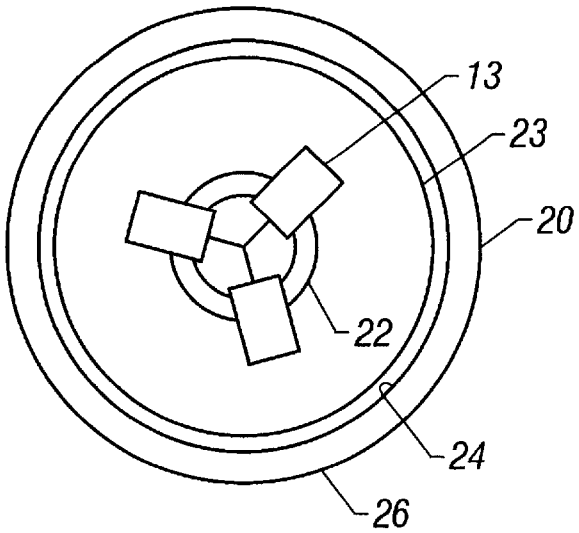
FIG. 2 is a cross-sectional view of the perforating gun including a first embodiment of the outer carrier.
Figure 3:
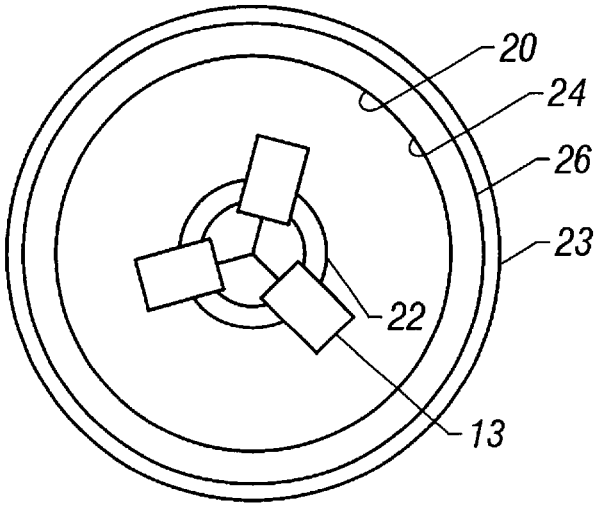
FIG. 3 is a cross-sectional view of the perforating gun including a second embodiment of the outer carrier.
Figure 4:
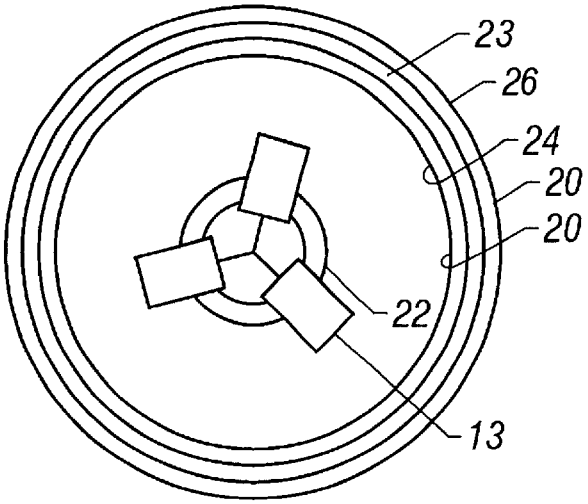
FIG. 4 is a cross-sectional view of the perforating gun including a third embodiment of the outer carrier

In one embodiment of our invention, the outer carrier 20 is constructed from a composite material. FIGS. 2–4 show a cross-sectional view of the perforating gun 14, including the outer carrier 20. As can be seen, the loading tube 22, which holds the shaped charges 13, is located interior to the outer carrier 20. A liner 23 is included in the outer carrier 20 to make the perforating gun 14 impermeable to the surrounding wellbore fluids. In one embodiment, the liner 23 is bonded to a surface of the carrier 20. For instance, the liner 23 can be bonded to the inner surface 24 of the carrier 20 as shown in FIG. 2 or to the outer surface 26 of the carrier 20 as shown in FIG. 3. In an alternative embodiment as shown in FIG. 4, the liner 23 is embedded within the carrier 20, wherein the liner 23 is preferably intermediate the inner surface 24 and the outer surface 26 of the carrier 20.

In another embodiment of our invention, the loading tube 22 is constructed from a composite material. Although not necessary since carrier 20 already makes perforating gun 14 impermeable to well fluids, loading tube 22 may also include a liner (not shown) if desired. Like the different ways in which the liner 23 is attached to the carrier 20, the liner included in the loading tube 22 can be bonded to the inner or outer surface of the loading tube 22 or can be embedded within the loading tube 22.

In another embodiment of the invention, at least one part of the connector assembly 19 is constructed from a composite material. The connector assembly 19 is the subject of a U.S. Patent Application entitled "Downhole Tool Release Mechanism" filed on even date herewith (hereinafter referred to as "Related Application"). The Related Application names Kothari, Parrott, Xu, and Li as inventors and is incorporated herein by reference.

Figure 5:
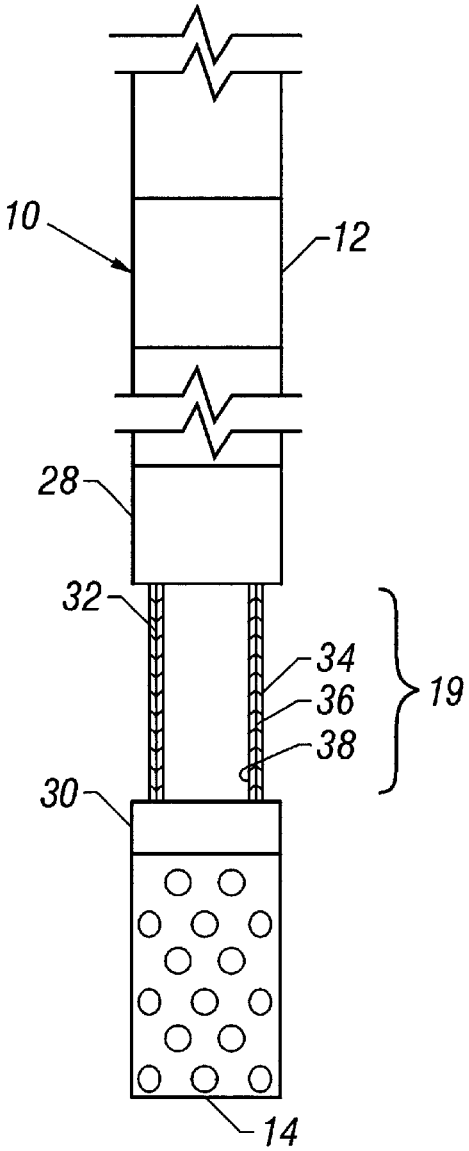
FIG. 5 is an elevational and partial cross-sectional view of the gun release mechanism prior to the perforating gun being fired.
Figure 6:
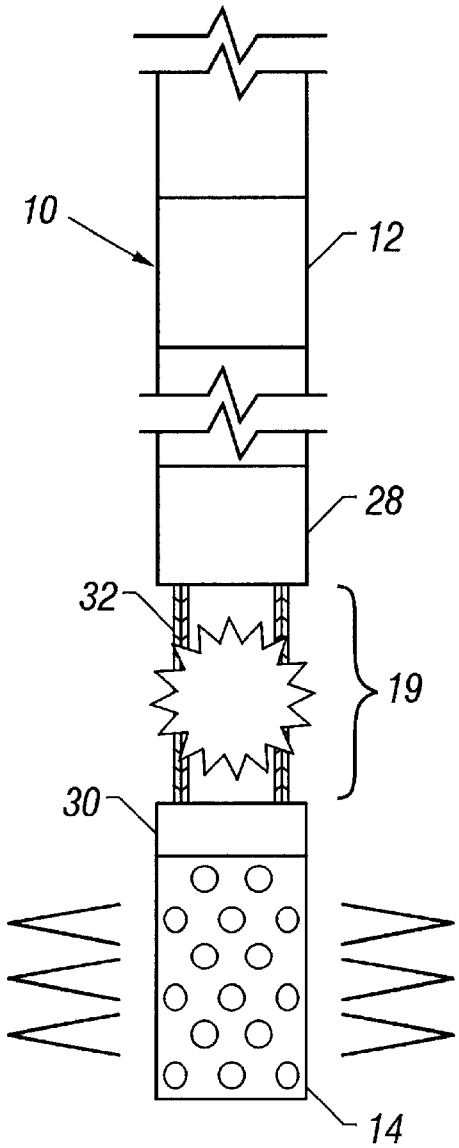
FIG. 6 is an elevational and partial cross-sectional view of the gun release mechanism as the perforating gun is being fired.
Figure 7:
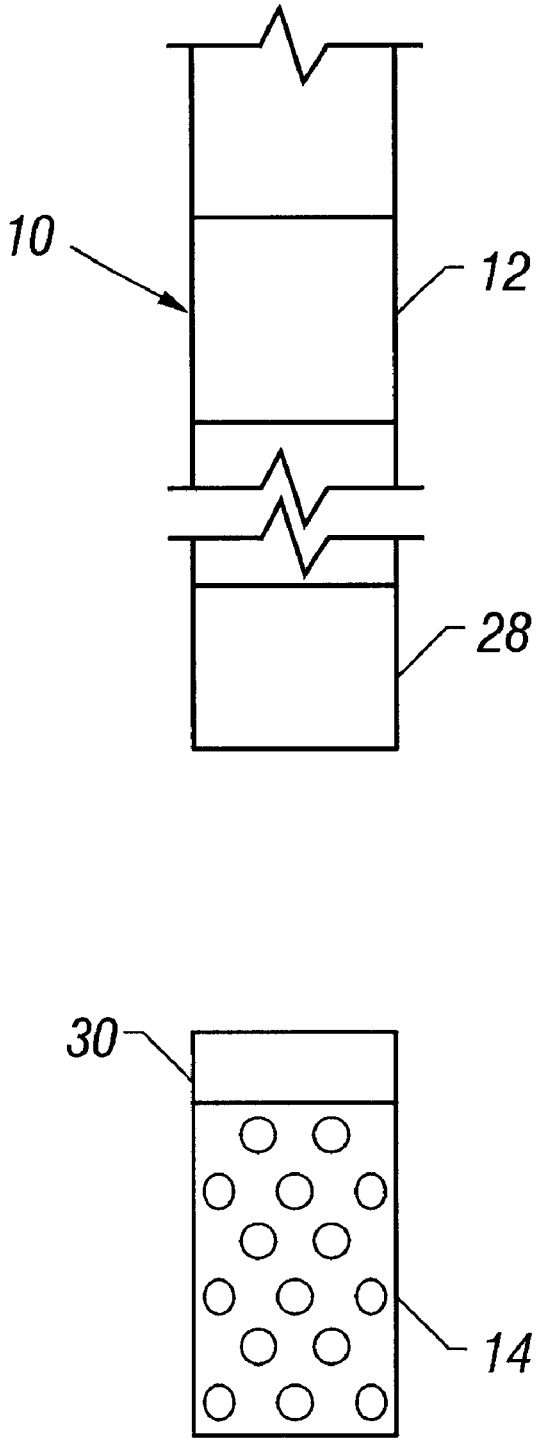
FIG. 7 is an elevational and partial cross-sectional view of the gun release mechanism after the perforating gun is fired.

For purposes of a brief explanation, several figures of the Related Application have been incorporated into this application as FIGS. 5–7. As shown in FIG. 5, the connector assembly 19 includes an upper connector 28 that, before the perforating gun(s) 14 are fired, is connected to an upper end of a tubing 32 and a lower connector 30 that, before the perforating gun(s) 14 are fired, is connected to a lower end of the composite tubing 32. The upper connector 28 is secured to the firing head 12, and the lower connector 30 is secured to the perforating gun 14. For the detailed description of the operation of the connector assembly 19, please consult the Related Application.

In one embodiment, the tubing 32 is constructed from a composite material. In addition, some embodiments of the connector assembly 19 include a pressure housing surrounding the tubing 32. The pressure housing is not shown in the Figures of this application, but it is shown in the Figures of the Related Application. For those embodiments not including the pressure housing, the tubing 32 should include a tubing liner 34 to make the connector assembly 19 (and thus also the perforating gun 14) impermeable to the surrounding wellbore fluids. Although the tubing liner 34 is shown bonded to the tubing outer surface 36 in FIG. 5, the tubing liner 34 can also be bonded to the tubing inner surface 38 (not shown) or can be embedded within the tubing 32 (not shown). These forms of attachment are similar to the different means by which the liner 23 is attached to the outer carrier 20.

In another embodiment of our invention, the connector 40 is constructed from a composite material. Composite connector 40 should include a liner (not shown). Like the different ways in which the liner 23 is attached to the carrier 20, the liner included in the connector 40 can be bonded to the inner or outer surface of the connector 40 or can be embedded within the connector 40.

OPERATION

The perforating gun assembly 10 is first deployed to the correct position in the downhole environment. In the deployed position, wellbore fluids surround the perforating gun assembly 10. It is noted that the use of composite materials in any of the perforating gun assembly components reduces the overall weight of the perforating gun assembly.

The liner 23 of the outer carrier 20 prevents the surrounding wellbore fluids from entering the perforating gun 14. Likewise, the tubing liner 34 prevents the surrounding wellbore fluids from entering the connecting assembly 19. And, the liner included in the connector(s) 40 prevents the surrounding wellbore fluids from entering the area interior to the connector(s) 40, such area likely being in fluid communication with the perforating gun 14 interior. Thus, the entire perforating gun assembly 10 is impermeable to the wellbore fluids, ensuring that the perforating gun 14 fires successfully. It is noted that if any of the listed components (as well as any other gun assembly components that are in communication with the surrounding wellbore fluids) are constructed from a composite material that is permeable, then the wellbore fluids would likely permeate through such components jeopardizing the successful operation of the perforating gun assembly 10, as previously disclosed.

In the embodiments in which the loading tube 22 is constructed from a composite material, when the shaped charges 13 are detonated, the energy of the detonation is transmitted to the loading tube 22. Being constructed from a composite material that is brittle under dynamic impact, the loading tube 22 expands and shatters into small pieces due to the energy transfer. The small pieces fall by gravity and are small enough that they do not present a problem to the subsequent operation of the wellbore.

In the embodiment in which the outer carrier 20 is constructed from a composite material, when the shaped charges 13 are detonated, the loading tube 22 expands due to case impact and explosive gaseous expansion. The amount of loading tube 22 expansion is limited by the inner diameter of the outer carrier 20. As soon as the loading tube 22 collides with the composite outer carrier 20, the energy from the loading tube 22 is transmitted to the outer carrier 20. Being constructed from a composite material that is brittle under dynamic impact, the outer carrier 20 shatters into small pieces upon collision with the loading tube 22. The small pieces fall to the rathole of the wellbore and are small enough that they do not present a problem to the subsequent operation of the wellbore. In addition, since the outer carrier 20 shattered into small pieces, the remainder of the perforating gun assembly 10 may be retrieved without fear of becoming lodged in the wellbore due to the outward swelling of the carrier.

In the embodiment in which the tubing 32 is constructed from a composite material, when the top perforating gun 14 fires, the connector assembly 19 releases the perforating guns from the rest of the string 10. More particularly, in response to the firing of the top perforating gun 14, the composite tubing 32 shatters into small pieces, as depicted in FIG. 6. The small pieces fall by gravity into the rathole and are small enough that they do not present a problem to the subsequent operation of the wellbore. The shattering of the composite tubing 32, in turn, releases the connector assembly 19 to sever the connection between the top perforating gun 14 and the firing head 12, as depicted in FIG. 7. As a result, the top perforating gun 14 and any other perforating guns(s) that are attached below the top perforating gun 14 drop into the rathole of the well. For the detailed description of the operation of the connector assembly 19, please consult the Related Application.

In the embodiments in which the connector 40 is constructed from a composite material, when the shaped charges 13 are detonated, the energy of the detonation is transmitted to the connector 40. Being constructed from a composite material that is brittle under dynamic impact, the connector 40 expands and shatters into small pieces due to the energy transfer. The small pieces fall by gravity into the rathole and are small enough that they do not present a problem to the subsequent operation of the wellbore.

Utilizing impermeable perforating gun assembly 10 components constructed out of composite materials as disclosed herein provides at least the following benefits: the perforating gun 14 shatters and does not swell after being fired; the perforating gun assembly 10 can be deployed in wellbores in which the minimum restriction diameter of the wellbore equals or substantially equals the outer diameter of the associated non-fired perforating gun 14; the perforating gun assembly 10 does not produce an obstruction for its retrieval after firing; the components do not fragment into large pieces as a result of firing and instead shatter into small pieces which fall into the rathole of the wellbore, which small pieces do not present a major problem or danger for the subsequent operation of the wellbore; the perforating gun assembly 10 is lighter than prior art perforating gun assemblies; and the safe and successful firing of the perforating gun 14 is ensured by making the composite components impermeable to the surrounding wellbore fluids thereby preventing the fluids from entering the interior of the perforating gun assembly 10.

It is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims. For instance, although not illustrated in the Figures, the impermeable perforating gun assembly 10 components constructed out of composite materials may also comprise members of the perforating gun assembly 10 other than the perforating gun 14, the connector assembly 19, and the connectors 40, such as firing heads, orienting tools, bottom noses, etc.

We claim:

1. A perforating gun assembly for use in a subterranean well comprising:

at least one component constructed from a composite material;

the component including a liner that is impermeable to well fluids;

the component being functionally associated with the perforating gun assembly; and the component shattering into small pieces upon firing the perforating gun of the perforating gun assembly.

2. The assembly of claim 1, wherein the liner is bonded to a surface of the component.

3. The assembly of claim 2, wherein the surface is an inner surface of the component.

4. The assembly of claim 2, wherein the surface is an outer surface of the component.

5. The assembly of claim 1, wherein the liner is embedded within the component.

6. The assembly of claim 1, wherein:

the perforating gun assembly includes a perforating gun having an outer carrier; and the component comprises the outer carrier.

7. The assembly of claim 6, wherein:

the perforating gun further includes a loading tube; and the component further comprises the loading tube.

8. The assembly of claim 6, further comprising:

a tubing string and a perforating gun release mechanism;

the perforating gun release mechanism including a tubing adapted to couple the perforating gun to the tubing string before the perforating gun is fired and to shatter in response to a firing of the perforating gun to release the perforating gun from the tubing string; and the component further comprising the tubing.

9. The assembly of claim 6, further comprising:

at least two perforating guns joined by a gun connector; and the component further comprises the gun connector.

10. The assembly of claim 1, wherein:

the perforating gun assembly includes a perforating gun having a loading tube; and the component comprises the loading tube.

11. The assembly of claim 1, wherein:

the perforating gun assembly includes a tubing string, a perforating gun, and a perforating gun release mechanism; and the component comprises a tubing of the perforating gun release mechanism adapted to couple the perforating gun to the tubing string before the perforating gun is fired and to shatter in response to a firing of the perforating gun to release the perforating gun from the tubing string.

12. The assembly of claim 1, wherein:

the perforating gun assembly includes at least two perforating guns joined by a gun connector; and the component comprises the gun connector.

13. The assembly of claim 1, wherein the composite material is constructed from fibers and a matrix material.

14. The assembly of claim 13, wherein the fibers are selected from a set consisting essentially of carbon, glass, kevlar, nomex, and aramid.

15. The assembly of claim 13, wherein the matrix material is selected from a set consisting essentially of polymers, ceramics, carbons, metals, and intermetallics.

16. The assembly of claim 1, wherein the liner is constructed from a material selected from a set consisting essentially of rubbers, thermoplastics, and thermoplastic elastomers.

17. A perforating gun assembly for use in a subterranean well comprising:

at least one component constructed from a composite material;

the component being impermeable to well fluids;

the component being functionally associated with the perforating gun assembly; and the component shattering into small pieces upon firing the perforating gun of the perforating gun assembly.

18. The assembly of claim 17, wherein:

the perforating gun assembly includes a perforating gun having an outer carrier; and the component comprises the outer carrier.

19. The assembly of claim 18, wherein:

the perforating gun further includes a loading tube; and the component further comprises the loading tube.

20. The assembly of claim 18, further comprising:

a tubing string and a perforating gun release mechanism;

the perforating gun release mechanism including a tubing adapted to couple the perforating gun to the tubing string before the perforating gun is fired and to shatter in response to a firing of the perforating gun to release the perforating gun from the tubing string; and the component further comprising the tubing.

21. The assembly of claim 17, wherein:

the perforating gun assembly includes at least two perforating guns joined by a gun connector; and the component further comprises the gun connector.

22. The assembly of claim 17, wherein:

the perforating gun assembly includes a perforating gun having a loading tube; and the component comprises the loading tube.

23. The assembly of claim 17, wherein:

the perforating gun assembly includes a tubing string, a perforating gun, and a perforating gun release mechanism; and the component comprises a tubing of the perforating gun release mechanism adapted to couple the perforating gun to the tubing string before the perforating gun is fired and to shatter in response to a firing of the perforating gun to release the perforating gun from the tubing string.

24. The assembly of claim 17, wherein:

the perforating gun assembly includes at least two perforating guns joined by a gun connector; and the component comprises the gun connector.

25. A method of operating a perforating gun assembly, comprising:

providing at least one component of the perforating gun assembly that is constructed from a composite material and that is impermeable to well fluids; and firing the perforating gun of the perforating gun assembly which results in the shattering of the composite component into small pieces.

26. A method of operating a perforating gun assembly, comprising:

providing at least one component of the perforating gun assembly that is constructed from a composite material and that includes a liner which is impermeable to well fluids; and firing the perforating gun of the perforating gun assembly which results in the shattering of the composite component into small pieces.

* * * * *